US005231946A

United States Patent [19]

Giles

[11] Patent Number: 5,231,946

[45] Date of Patent: * Aug. 3, 1993

[54] MONOHULL FAST SEALIFT OR SEMI-PLANING MONOHULL SHIP

[76] Inventor: David L. Giles, 4244 Hunt Club Cir., Apt. 1534, Fairfax, Va. 22033

[ * ] Notice: The portion of the term of this patent subsequent to Jan. 14, 2009 has been disclaimed.

[21] Appl. No.: 820,147

[22] Filed: Jan. 13, 1992

Related U.S. Application Data

[63] Continuation of Ser. No. 525,072, May 18, 1990, Pat. No. 5,080,032.

[30] Foreign Application Priority Data

Oct. 11, 1989 [GB] United Kingdom ..... 8922936

[51] Int. Cl.[5] ..... B63B 1/04

[52] U.S. Cl. ..... 114/56; 114/121; 114/271; 440/3; 440/38

[58] Field of Search ..... 440/40–43, 440/3, 4, 38, 6; 114/56, 121, 125, 271

[56] References Cited

U.S. PATENT DOCUMENTS

| | | | |
|---|---|---|---|
| 145,347 | 12/1873 | Hirsch . | |
| 1,270,134 | 6/1918 | Emmet | 440/6 |
| 2,185,430 | 1/1940 | Burgess | 114/56 |
| 2,185,431 | 1/1940 | Burgess | 114/56 |
| 2,342,707 | 2/1944 | Troyer | 114/56 |
| 2,570,595 | 10/1951 | Romero | 114/56 |
| 3,122,121 | 2/1964 | Krauta | 440/40 |
| 3,225,729 | 12/1965 | Ewing, Jr. | 114/290 |
| 3,342,032 | 9/1967 | Cox et al. | 60/221 |
| 3,776,168 | 12/1973 | Weeks | 114/56 |
| 3,826,218 | 7/1974 | Hiersig et al. | 440/3 X |
| 3,911,846 | 10/1975 | England | 114/291 |
| 3,995,575 | 12/1976 | Jones, Jr. | 114/56 |
| 4,004,542 | 1/1977 | Holmes | 440/38 |
| 4,079,688 | 3/1978 | Diry | 114/56 |
| 4,276,035 | 6/1981 | Kobayashi | 440/47 |
| 4,523,536 | 6/1985 | Smoot | 114/67 R |
| 4,611,999 | 9/1986 | Haynes | 440/47 |
| 4,631,032 | 12/1986 | Nishida | 440/47 |
| 4,649,851 | 3/1987 | April | 114/271 |
| 4,713,027 | 12/1987 | Fowler | 440/47 |
| 4,718,870 | 1/1988 | Watts | 440/47 |
| 4,775,341 | 10/1988 | Tyler et al. | 440/38 |
| 4,843,993 | 7/1989 | Markion | 114/125 |
| 5,080,032 | 1/1992 | GIles | 114/56 |

FOREIGN PATENT DOCUMENTS

| | | |
|---|---|---|
| 409181 | 4/1934 | United Kingdom . |
| 739771 | 11/1955 | United Kingdom . |

OTHER PUBLICATIONS

"Hull Form for Warships", Hill-Norton Committe Report, United Kingdon, 1986.

"Warship Hull Design Inquiry", Lloyd's Register of Shipping, London 1988.

*Primary Examiner*—Sherman Basinger

*Attorney, Agent, or Firm*—Antonelli, Terry, Stout & Kraus

[57] ABSTRACT

A vessel (10) has a semi-displacement or semi-planing round bilge hull (11) characterized by low length-to-beam ratio (between about 5.0 to 7.0) and utilizing hydrodynamic lift. The bottom (15) of the hull (11) rises toward the stern (17) and flattens out at the transom (30). Four waterjet propulsion units (26, 27, 28, 29) are mounted at the transom (30) with inlets (31) arranged on the hull bottom (15) just forward of the transom (30) in a high pressure area. Water under high pressure is directed to the pumps (32) from the inlets (31). Eight marine gas turbines arranged in pairs (36/37, 38/39, 40/41, 42/43) power the waterjet propulsion units (26, 27, 28, 29) through combined gearboxes (44, 45, 46, 47) and cardan shafts (48, 49, 50, 51).

8 Claims, 13 Drawing Sheets

○ AT 45 KNOTS
● AT 30 KNOTS
○MFS
DDG-51
CGN 38
MFS
KIROV
CVN 68
CG-47
SL-7
SPECIFIC POWER $\left(\frac{HP}{D \times V}\right)$
0.5
0.4
0.3
0.2
0.1
0
400
500
600
700
800
900
1000
1100
LENGTH - FEET

MONOHULL FAST SEALIFT OR SEMI-PLANING MONOHULL SHIP

This is a continuation application of U.S. Ser. No. 07/525,072, filed May 18, 1990, and now U.S. Pat. No. 5,080,032.

TECHNICAL FIELD

The present invention relates to a monohull fast sealift (MFS) or semi-planing monohull (SPMH) ship and, more particularly, to a fast ship whose hull design in combination with a waterjet propulsion system permits, for ships of about 25,000 to 30,000 tons displacement with a cargo carrying capacity of 5,000 tons, transoceanic transit speeds of up to 40 to 50 knots in high or adverse sea states, speeds heretofore not achievable in ships of such size without impairment of stability or cargo capacity such as to render them impracticable.

BACKGROUND ART

It has long been the goal of naval architects to design and construct vessels with large cargo capacities and internal accommodations, structural strength, stability and steadiness when the vessel is afloat and sufficiently small resistance to economize propelling power as evidenced by U.S. Pat. No. 145,347.

Traditional surface ship monohull designs have usually been developed from established design principles and assumptions which concern the interrelationships of speed, stability and seakeeping. Sacrifices are made to achieve desired performance factors. As a result, current practical monohull surface ship improvements are essentially stalled.

For example, a major limitation of present day displacement hulls is that, for a given size (in terms of displacement or volume), their seaworthiness and stability are reduced as they are "stretched" to a greater length in order to increase maximum practical speed.

Traditional hull designs inherently limit the speed with which large ships can traverse the ocean because of the drag rise which occurs at a speed of about 1.2 times the square root of the ship's length (in feet). For example, a mid-size cargo ship has a top speed of about 20 knots. In order to achieve higher speeds with commercial loads, it is necessary to increase ship length and size (or volume) in proportion, or to increase length while reducing beam, to maintain the same size and volume, but at the expense of stability. Naval architects have long considered the problem of achieving significantly higher ship speeds without increasing length or decreasing beam as the equivalent of "breaking the sound barrier" in aeronautical technology.

Increased length is required for higher speed (except in the case of very narrow hulls which are not practical cargo carriers due to limitations of volume and stability) because of the huge drag rise which occurs at a speed corresponding to a Froude Number of 0.4. The Froude number is defined by the relationship $0.298\ V/\sqrt{L}$, where V is the speed of the ship in knots and L is the waterline length of the ship in feet. To go faster the ship must be made longer, thus pushing the onset of this drag rise up to a higher speed. As length is increased for the same volume, however, the ship becomes narrower, stability is sacrificed, and it is subject to greater stress, resulting in a structure which must be proportionately lighter and stronger (and more costly) if structural weight is not to become excessive. In addition, while for a given displacement the longer ship will be able to achieve higher speeds, the natural longitudinal vibration frequency is lowered and seakeeping degraded in high or adverse sea states as compared to a shorter, more compact ship.

There is an increasing need for surface ships that can transit oceans with greater speed, i.e. in the range of forty to fifty knots, and with high stability because of the commercial requirements for rapid and safe ocean transits of perishable cargoes, high cost capital goods cargoes whose dimensions and density cannot be accepted for air freight, and other time-sensitive freight, particularly in light of the increasing worldwide acceptance of "just-in-time" inventory and stocking practices.

Today, the maximum practical speed of displacement ships is about 32 to 35 knots. This can be achieved in a relatively small ship by making it long, narrow and light but also costly. To some extent it has been possible to avoid increased length above Froude numbers of 0.4, but this has been achieved in small craft design using semi-planing hulls for ships up to 120 feet long and 200 tons and improved propulsion units. In a larger ship, such as a fast ocean liner, the greater length allows a greater size and volume to be carried at the same speed which is, however, lower relative to its Froude number (i.e., 38 knots for an aircraft carrier of 1,100 feet waterline length is only a Froude number of 0.34). On the negative side, the larger size of these ships requires significantly larger quantities of propulsion power. There are major problems in delivering this power efficiently through conventional propellers due to cavitation problems and using conventional diesel or steam machinery which provide a very poor power/weight ratio.

Another means to achieve high speed ships is the planing hull. This popular design is limited to a very short hull form, i.e. typically no more than 100 feet and 100 tons. Boats of only 50 foot length are able to achieve speeds of over 60 knots (or a Froude number of 2.49). This possible because the power available simply pushes the boat up onto the surface of the water where it aquaplanes across the waves, thus eliminating the huge drag rise which prohibits a pure displacement boat from going more than about 12 knots on the same length of hull. However, at intermediate speeds of say 5 to 25 knots, before the boat "gets onto the plane", a disproportionately large amount of power is required. If a 50 foot boat is scaled to the length of a frigate of 300 feet, the speed scales to the precise range of 12 to 60 knots. Thus scaled, the power required for a 300 foot planing frigate would be about half a million horsepower. Furthermore, the ensuing ride on this 300 foot ship would cause material fatigue as its large flat hull surface would be slammed at continuously high speed into the ocean waves inasmuch as it would be too slow to plane or "fly" across the waves as a much smaller planing ship would do.

Craft utilizing planing hulls have also been produced with waterjet propulsion. Due to limitations of size, tonnage and required horsepower, however, the use of a waterjet propelled planing hull vessel for craft over a certain waterline length or tonnage have not been seriously considered.

In light of the foregoing, I have concluded that the planing hull of the types shown, for example, in U.S. Pat. No. 3,225,729 does not yield the solution to designing large fast ships. However, if the speed categories in relation to waterline length shown in FIG. 13 herein are examined, the semi-planing hull appears to offer attractive opportunities for fast sealift ships. FIG. 13 described hereinbelow shows a continuum of sizes of semi-planing hulls, small to very large. The monohull fast sealift (MFS) hull or semi-planing monohull (SPMH) design is the hull form which is widely used today in smaller semi-planing ships because it offers the possibility of using waterline lengths approaching that of displacement hulls and maximum speeds approaching that of planing hulls.

Hull designs using the concept of hydrodynamic lift are known with regard to smaller ships, e.g. below 200 feet or 200 tons powered by conventional propeller drives as shown in U.S. Pat. No. 4,649,851. The shape of such a hull is such that high pressure is induced under the hull in an area having a specific shape to provide hydrodynamic lift. The MFS or SPMH ship develops hydrodynamic lift above a certain threshold speed as a result of the presence of high pressure at the aft part of the hull. Such a hull reduces the residuary resistance of the hull in water as shown in FIGS. 11 and 14 described below. Therefore, power and fuel requirements are decreased. Since hydrodynamic lift increases as the square of the velocity, a lifting hull allows higher speeds to be achieved. Working boats utilizing the MFS hull or SPMH form are now being used at sea or in many of the world's harbour approaches. This hull form has also up to now been considered limited to certain size fast pilot boats, police launches, rescue launches and fast lifeboats, custom launches, patrol boats, and even motor yachts and fast fishing boats which range in size from 16 to 200 feet (from 2 to about 600 tons). For their size, these boats are much heavier and sturdier than the planing boats. In the speed range of 5 to 25 knots, they have a much smoother ride. They also use much less power for their size at Froude numbers lower than 3.0 than does the planing hull, and they are very maneuverable. However, it has generally been accepted that the practical use of this type of hull is limited to a ship of 200 tons.

FIG. 11 shows a shaft horsepower comparison between an MFS or SPMH frigate (curve A with the circle data points) and a traditional frigate hull (curve B with the triangular data points) of the same length-/beam ratio and 3400 tons displacement. Between about 15 and approximately 29 knots both ships require similar power. From 38 up to 60 knots the MFS ship would operate within the area of its greatest efficiency and benefit increasingly from hydrodynamic lift. This speed range would be largely beyond the practicability for a traditional displacement hull unless the length of a displacement hull was increased substantially in order to reduce Froude numbers or the length to beam ratios were substantially increased. Hydrodynamic lift in an MFS or SPMH design is a gentler process which is more akin to a high speed performance sailing boat than the planing hull which is raised onto the plane largely by brute force. An MFS or SPMH hull does not fully plane and thereby avoids the problem of slamming against waves at high speeds.

In addition, modern large ships have traditionally been propeller driven with diesel power. Propellers are, however, inherently limited in size, and they also present cavitation and vibration problems. It is generally recognized that applying state-of-the-art technology, 60,000 horsepower is about the upper limit, per shaft, for conventional fixed pitch propellers. Moreover, diesel engines sized to produce the necessary power for higher speeds would be impractical because of weight, size, cost and fuel consumption considerations.

Waterjet propulsion systems which substantially reduce the cavitation and vibration problem of propeller drives are known as shown in U.S. Pat. Nos. 2,570,595; 3,342,032; 3,776,168; 3,911,846; 3,995,575; 4,004,542; 4,611,999; 4,631,032; 4,713,027; and 4,718,870. To date they have not been perceived as useful for propelling larger ships, particularly at high speeds, and are deemed generally too inefficient because they require high pressure at the water inlet in the aft part of the submerged hull, rather than low pressure which generally exists at that portion of large displacement hulls.

DISCLOSURE OF INVENTION

It is an object of the present invention to overcome the problems and limitations encountered in previous hull designs and propulsion systems for fast commercial ships in excess of 2000 tons and pleasure craft in excess of 600 tons.

Another object of the present invention is the achievement of a fast yet large commercial ship such as a cargo ship or vehicle ferry in excess of 2000 tons or 200 feet which attains a greater turnover on investment to offset the higher capital and operating costs.

Another object of the present invention is the achievement of seaworthiness in open ocean conditions superior to that of current commercial ship and pleasure craft designs.

Further objects of the present invention are the greater frequency of service per ship and less need to inter port among several ports on each side of a crossing to increase the cargo loaded onto a ship of sufficient length and size necessary to achieve the high speed required to reduce crossing time significantly.

Yet another object of the present invention is the attainment of a wider speed envelope which allows more flexible scheduling and greater on-time dependability.

Still further objects of the present invention include the production of a commercial ship with smaller or shallow harbor access and greater maneuverability, thanks to having waterjets and a built-in trimming or fuel transfer system rather than conventional underwater appendages such as rudders or propellers.

The present invention is particularly useful in commercial ships having a waterline length (L) of about 600 feet, an overall beam (B) of about 115 feet, and a full load displacement of about 25,000 to 30,000 tons. However, it is generally applicable to pleasure craft in excess of 600 tons and commercial ships in excess of 2000 tons and 200 feet.

For purposes of steering, a system employing wing waterjets for speeds up to 20 knots would be used. Furthermore, the wing waterjets can incorporate a reversing system. As a result, a ship utilizing my inventive concept will be maneuverable at standstill.

The present invention utilizes a known monohull semi-planing design with inherent hydrodynamic lift and low length-to-beam (L/B) ratio but in a heretofore unknown combination with gas turbine power and waterjet propulsion which requires, for best efficiency, high pressure at the inlet of the waterjets which I have recognized corresponds to the stern area of the semi-planing hull where high pressure is generated to lift the hull.

An advantage of a waterjet propulsion system in the semi-planing hull is its ability to deliver large amounts of power at high propulsive efficiency at speeds of over 30 knots and yet decelerate the ship to a stop very quickly. The system also largely eliminates the major problems of propeller vibration, noise and cavitation. A principal advantage of the integrated MFS hull or SPMH and waterjet system is that the shape and lift characteristics of the hull are ideal for the intakes and propulsive efficiency of the waterjet system, while the accelerated flow at the intakes also produces higher pressure and greater lift to reduce drag on the hull even further.

Since it is advantageous for waterjet propulsion systems to have an area of higher pressure in the vicinity of the water inlet and since a larger flat transom area is required to install the jet units, the MFS or SPMH hull form is ideally suited for waterjet propulsion. A highly efficient propulsion system, combined with gas turbine main engines, can be provided to meet the higher power levels required for large, high speed ships.

A further advantage of the present invention is that the inherent low length-to-beam ratio provides greater usable cargo space and improved stability.

Yet another advantage of the present invention is provided by the waterjet propulsion which yields greater maneuverability than with propellers due to the directional thrust of the wing waterjets and the application of high maneuvering power without forward speed.

An additional advantage of the present invention is the use of waterjet propulsion units or pumps driven by marine gas turbine units which produce an axial or mixed flow of substantial power without the size, cavitation and vibration problems inherent in propeller drives.

Still a further advantage of the present invention resides in the reduced radiated noise and wake signatures due to the novel hull design and waterjet propulsion system.

The present invention has a further advantage due to the ability economically to produce its monohull structure in available commercial shipyards.

A further advantage of the present invention is the utilization of marine gas turbine engines which either presently produce, or are being developed to produce greater power for a lower proportional weight, volume, cost and specific fuel consumption than has been available with diesel powered propeller drives.

A further advantage of the present invention arises from the hull underwater shape which avoids the traditional drag rise in merchant ships. Due to the hull shape of the present invention, the stern of the ship begins to lift (thereby reducing trim) at a speed where the stern of a conventional hull begins to squat or sink.

The present invention combines the power and weight efficiencies of marine gas turbines, the propulsive efficiency of waterjets, and the hydrodynamic efficiency of a hull shaped to lift at speeds where traditional hulls squat. The present invention finds particular utility for maritime industry vessels in excess of 200 feet overall length, 28 feet beam and 15 feet draft.

A hull of the fast semi-planing type experiences lift due to the action of dynamic forces and operates at maximum speeds in the range of Froude Numbers 0.3 to 1.0. This type of hull is characterized by straight entrance waterlines, afterbody sections which are typically rounded at the turn of the bilge, and either straight aft buttock lines or buttock lines with a slight downward hook terminating sharply at a transom stern.

In a presently contemplated embodiment used, for example, as a merchant ship, the ship according to the present invention will utilize eight conventional marine gas turbines of the type currently manufactured by General Electric under the designation LM 5000 and four waterjets of the general type currently manufactured by Riva Calzoni or KaMeWa. The waterjet propulsion system has pump impellers mounted at the transom and water ducted to the impellers from under the stern through inlets in the hull bottom just forward of the transom. The inlets are disposed in an area of high pressure to increase the propulsive efficiency of the waterjet system.

Actually the acceleration of flow created by the pumps at or around the inlet produces additional dynamic lift which also increases the efficiency of the hull. The result is an improvement in overall propulsive efficiency compared to a hull with a conventional propeller propulsion system, with the most improvement in propulsion efficiency beginning at speeds of about 30 knots.

Maneuvering is accomplished with two wing waterjets, each wing jet being fitted with a horizontally pivoting nozzle to provide angled thrust for steering. A deflector plate directs the jet thrust forward to provide stopping and slowing control. Steering and reversing mechanisms are operated by hydraulic cylinders positioned on the jet units behind the transom.

Accordingly, a ship utilizing such an MFS hull or SPMH with waterjet propulsion will be able to transport about 5,000 tons of cargo at about 45 knots across the Atlantic Ocean in about 3 ½ days or about 11,000 tons of cargo at about 35 knots in 4 ½ days in sea states up to 5, with a 10% reserve fuel capacity.

It is further contemplated that an integrated control system will be provided to control gas turbine fuel flow and power turbine speed, and gas turbine acceleration and deceleration, to monitor and control gas turbine output torque, and to control the waterjet steering angle, the rate of change of that angle, and the waterjet reversing mechanism for optimum stopping performance. Such a system can use as inputs parameters which include ship speed, shaft speed, gas turbine power output (or torque).

The foregoing control system will allow full steering angles at applied gas turbine power corresponding to a ship speed of about 20 knots. It will progressively reduce the applied steering angle automatically at higher power and ship speeds and further allow full reversing of the waterjet thrust deflector at applied gas turbine power corresponding to a ship speed of around 20 knots. Moreover, the control system will automatically limit waterjet reversing deflector movement and rate of movement at higher power and control the gas turbine power and speed to be most effective at high ship speeds.

In summary, the advanced MFS or SPMH form has the following advantages:

1. Lower hull resistance at high ship speeds compared to a conventional hull of the same proportions.
2. High inherent stability allowing large quantity of cargo to be carried above the main deck with adequate reserve of stability.
3. High inherent stability has the effect that there is no requirement for the vessel to be ballasted as fuel is consumed, thus providing increasing top speed with distance travelled.

4. Low L/B ratios provides large usable internal volume compared with a similar displacement conventional vessel.
5. Large potential reserve of damage stability.
6. Ability to operate at high speed in adverse weather conditions without (a) causing excessive hull strength problems (b) having adverse subjective motion (c) excessive hull slamming and deck wetness.
7. Ability to operate effectively and efficiently on two, three, or four waterjets due to a favorable combination of hull, waterjet and gas turbine characteristics.
8. Ability to accommodate four large waterjets across the ship transom and provide sufficient bottom area for their intakes.
9. Integration of the waterjet/gas turbine propulsion system is optimized by the aft section hull form.
10. Lower technical risk than a conventional hull form of similar displacement for the speed range 40 to 50 knots.
11. Superior maneuverability at both low and high speeds and ability to stop in a much shorter distance.
12. Arrangement with all propulsion machinery aft maximizes cargo loading and cargo handling and stowages.
13. Ability to utilize a fuel trimming system, as would be incorporated in the design for ensuring optimum longitudinal center of gravity at all speeds and displacements, for other uses such as operating in shallow water or for amphibious purposes.
14. Lack of rudders or propellers and associated appendages reducing the possibility of underwater damage in shallow water, maneuvering or in amphibious operations.

BRIEF DESCRIPTION OF THE DRAWINGS

These and further features, objects and advantages of the present invention will become more apparent from the following description of the best mode for carrying out the invention when taken in conjunction with the accompanying drawings wherein.

BEST MODE FOR CARRYING OUT THE INVENTION

Figure 3:
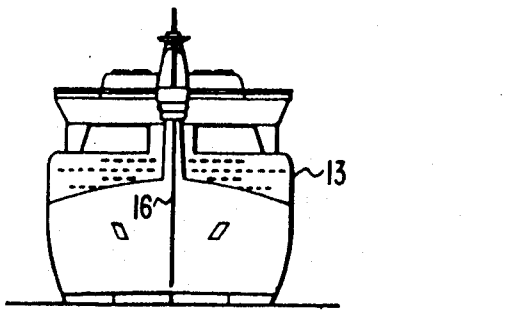
FIG. 3 is a front elevational view, i.e. looking at the bow, of the ship shown in FIG. 1.
Figure 1:
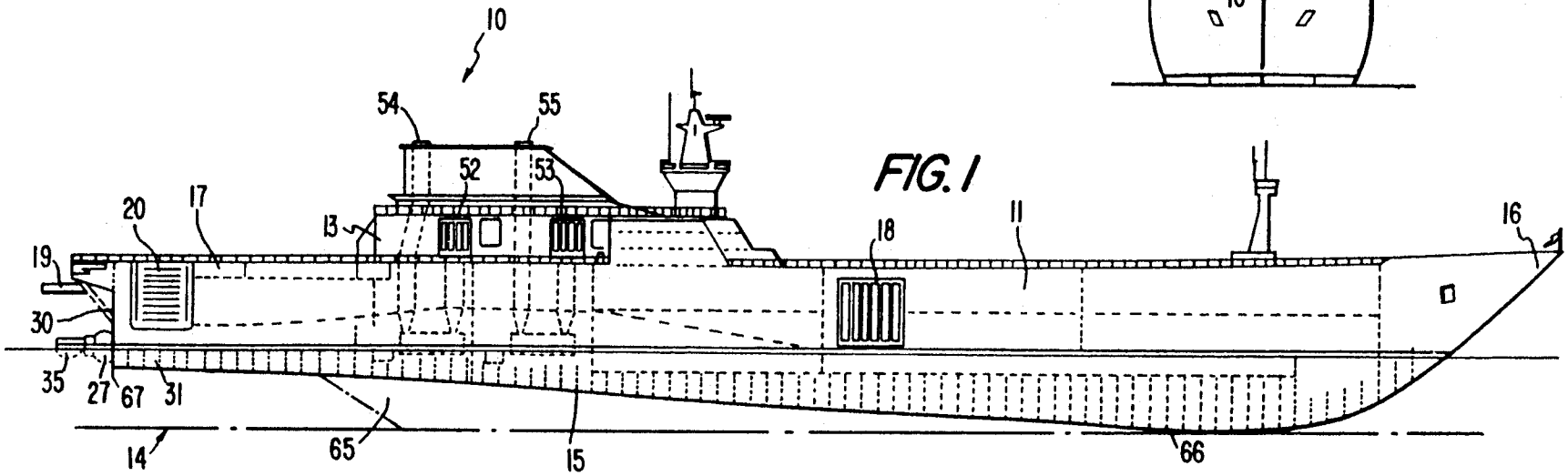
FIG. 1 is a side elevational view of the starboard side of a ship in accordance with the present invention.

Referring now to the drawings and, in particular to FIG. 1, there is shown a ship, designated generally by the numeral 10, having a semi-displacement or semi-planing round bilge, low length-to-beam (L/B) hull form utilizing hydrodynamic lift at high payloads, e.g. up to 5000 tons for transatlantic operation at speeds in the range of 40 to 50 knots. The L/B ratio is contemplated to be between about 5.0 and 7.0, although it can be increased somewhat above 7.0 to permit Panama Canal transit capability where that feature is important.

The ship 10 has a hull 11 known as a semi-planing round-bilge type with a weather deck 12. A pilot house superstructure 13 is located aft of amidships to provide a large forward deck for cargo and/or helicopter landing, and contains accommodations, living space and the controls for the ship as well as other equipment as will be hereinafter described. The superstructure 13 is positioned so as not to adversely affect the longitudinal center of gravity. Although a commercial vessel is depicted in the form of a cargo ship in excess of 200 feet and 2000 tons displacement, the present invention is also applicable to pleasure craft in excess of 600 tons.

Figure 4:
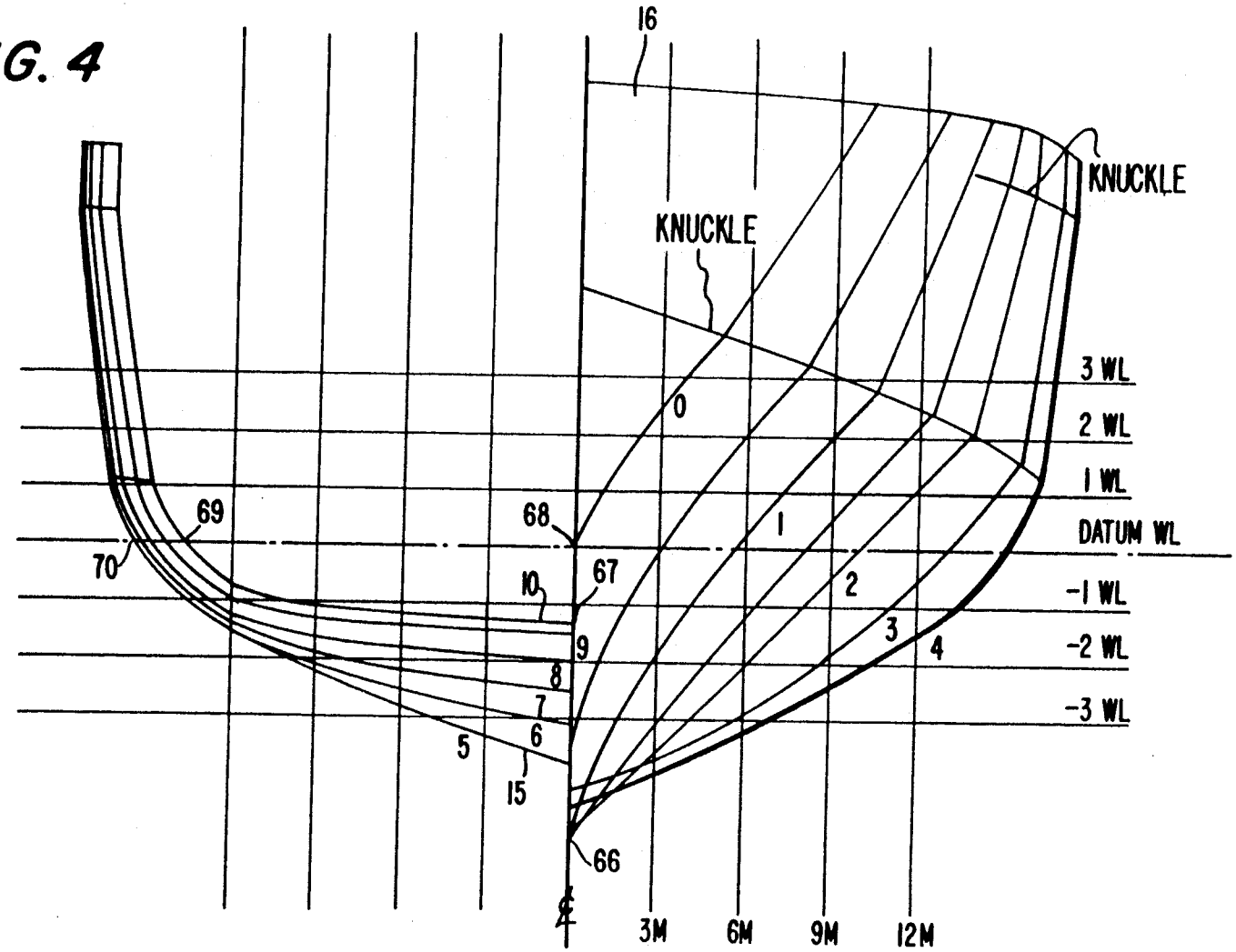
FIG. 4 is a profile view of the hull showing different contour lines at stations along the length of the hull shown in FIG. 1, half from the bow section and half from the stern section.

The longitudinal profile of the hull 11 is shown in FIG. 1, while the body plan is shown in FIG. 4. A base line 14 shown in dashed lines in FIG. 1 depicts how the bottom 15 of the hull rises towards the stern 17 and flattens out at the transom 30.

Figure 14:
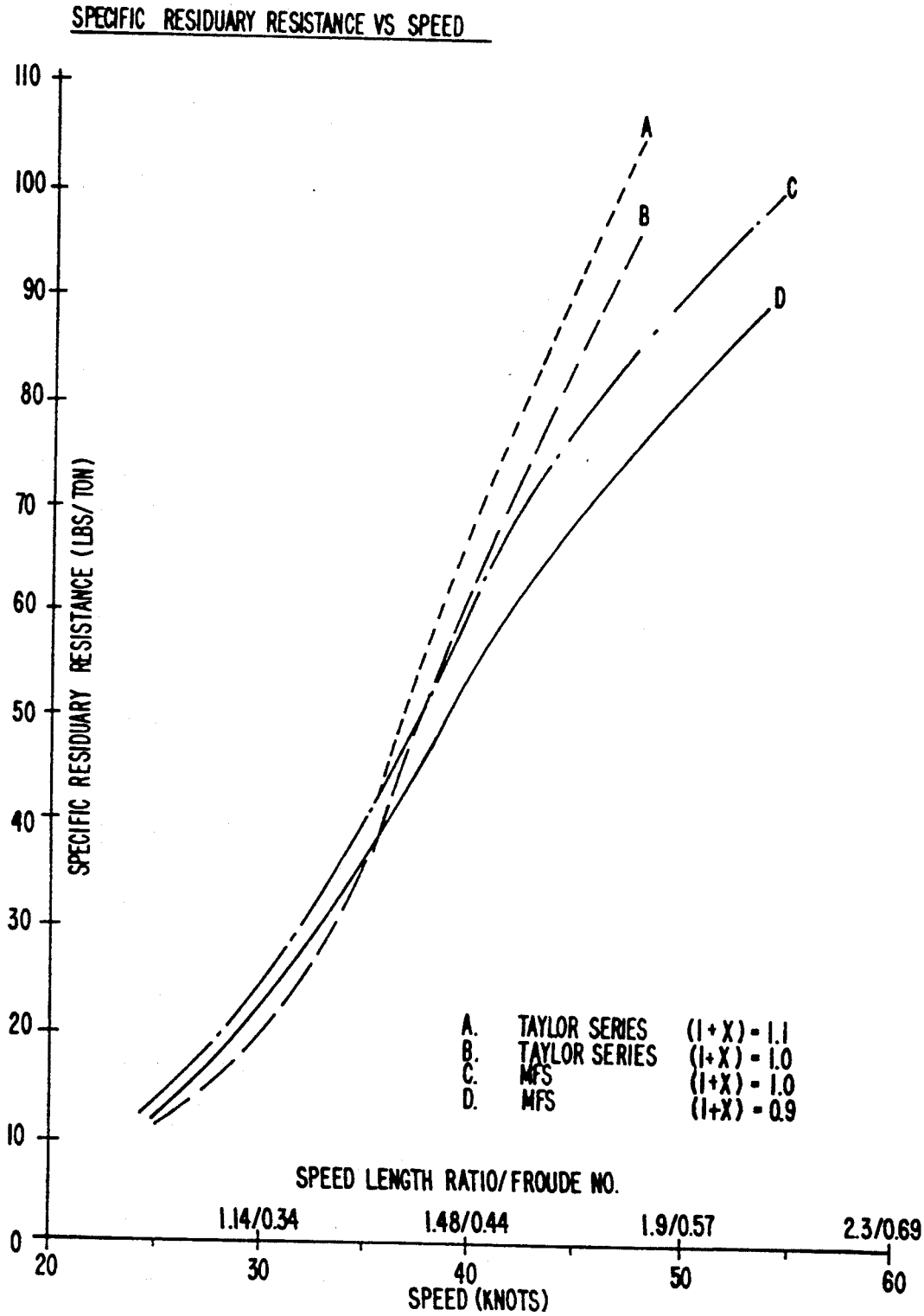
FIG. 14 is a graph of specific residuary resistance in relation to ship speed demonstrating how the MFS hull or SPMH used in the present invention provides reduced drag at increased speeds compared with conventional displacement hulls of the same proportions.

FIG. 4 is a profile of the semi-planing hull form, with the right side showing the configuration at the forward section of the ship and the left side showing the configuration at the aft section. The profile describes the cross-section of the hull in terms of meters from the beam center line and also in relation to multiples of waterline from the datum waterline. It is generally known that this type of semi-displacement or semi-planing hull has a traditional displacement hull shape with a keel in the forward section and a flattened bottom in the aft section. In smaller vessels, a centerline vertical keel or skeg 65 shown in phantom lines in FIG. 1 and designated by the numeral 65 may be fitted, extending from about the deepest point of the forward bilge to a point about one-quarter to one-third of the ship's length forward of the transom 30. The hull is shown as having a non-stepped profile. This keel or skeg improves directional stability and roll damping in smaller ships. It is this hull configuration which produces at a threshold speed a hydrodynamic lift under the aft section to reduce drag in relation to conventional displacement hulls as demonstrated in FIG. 14. Contour lines numbered 0–4 in FIG. 4 show the conventional form of hull shape in the bow section 16 viewed from right to left in FIG. 1, whereas the contour lines numbered 5–10 show how the bilge in the stern section 17 becomes flattened as also viewed from right to left in FIG. 1. Although there is presently no agreed upon method for determining the onset of hydrodynamic lift as a result of the size and shape of this hull, it has been suggested that such lift takes place at a threshold speed of about 26.5 knots at a displacement of 22,000 tons, in the case of this ship.

The round-bilge hull thus has a "lifting" transom stern 17 which, as is known, is produced by the hydrodynamic force resulting from the hull form which is generally characterized by straight entrance waterlines, rounded afterbody sections typically rounded at the turn of the bilge and either straight aft buttock lines or aft buttock lines with a slight downward hook terminating sharply at the transom. This type of hull is not a planing hull. It is designed to operate at maximum speeds in the Froude Number range of above about 0.4 and below about 1.0 (preferably between 0.42 and 0.90) by creating hydrodynamic lift at the afterbody of the hull by the action of high pressure under the stern and reducing drag.

Figure 5:
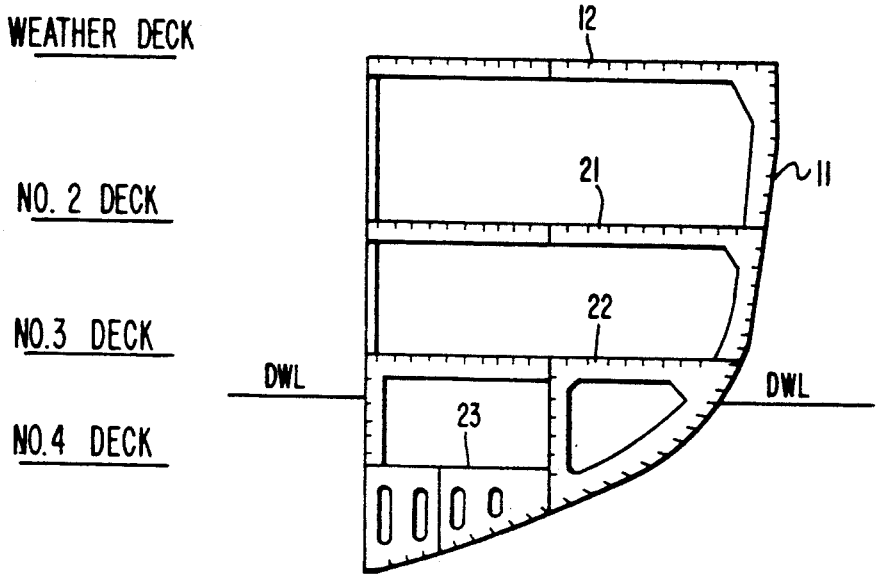
FIG. 5 is a cross-sectional view of the midship section of the hull shown in FIG. 1 to show the arrangement of the decks.

The hull 11 is also provided with an access ramp 18 amidship on the starboard side and a stern roll-on/roll-off ramp 19 so that cargo stored at the three internal decks 21, 22, 23 below the weather deck 12, as illustrated on the midship section shown in FIG. 5, having interconnecting lifts (not shown) can be accessed simultaneously for loading and unloading. Other access ramps can be strategically located such as a ramp 20 provided on the starboard side aft.

Because of the shorter hull design, the hull will achieve required structural strength with greater ease than a long, slender ship for a given displacement. The shape which produces hydrodynamic lift in the form of a semi-planing hull is well known and its dimensions can be determined by requirements of payload, speed, available power and propulsor configuration. A three-dimensional hull modeling computer program of a commercially available type can generate the basic MFS hull or SPMH form with the foregoing requirements as inputs. Once the basic hull parameters are determined, an estimate of the displacement can be made using, for example, two-digit analysis with weight codings from the standard Shipwork Breakdown Structure Reference 0900-Lp-039-9010.

In addition, the shorter hull produces a higher natural frequency which makes the hull stiffer and less prone to failure due to dynamic stress caused by waves, while allowing, in combination with the propulsion system hereinafter described, achievement of speeds in the 40 to 50 knot range.

Waterjet propulsors utilizing existing mixed flow, low pressure, high volume pump technology to produce very high thrust on the order of 200 tons are incorporated in the ship constituting the present invention. The waterjet propulsors are driven by conventional marine gas turbines sized to obtain the high power required. The waterjet propulsor presently contemplated for use is a single stage design which is uncomplicated in construction, and produces both high efficiency and low underwater noise at propulsion power in excess of 100,000 HP.

Figure 15:
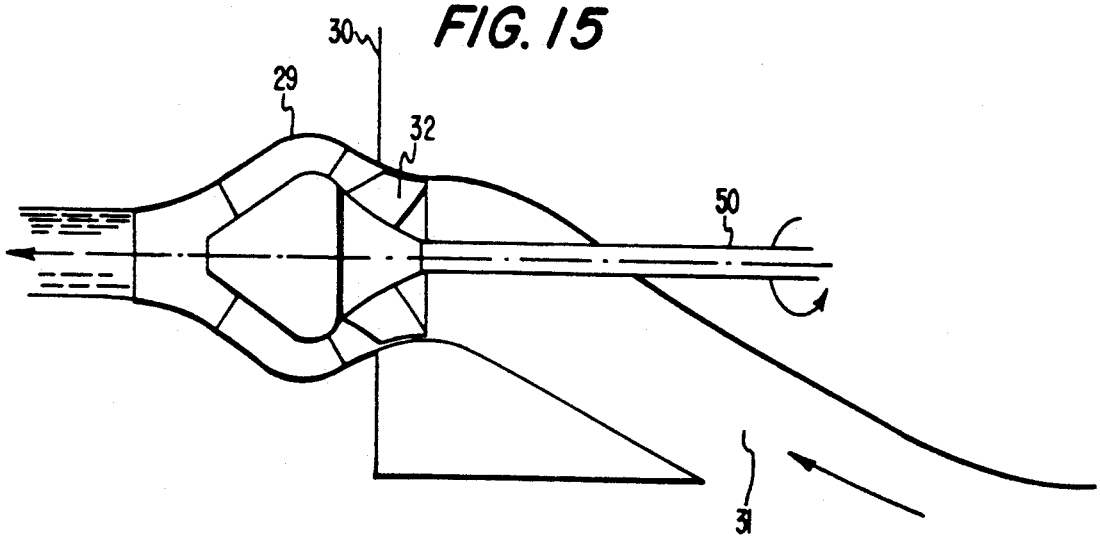
FIG. 15 is a schematic view showing the waterjet propulsion system used in the ship depicted in FIGS. 1-3.
Figure 6:
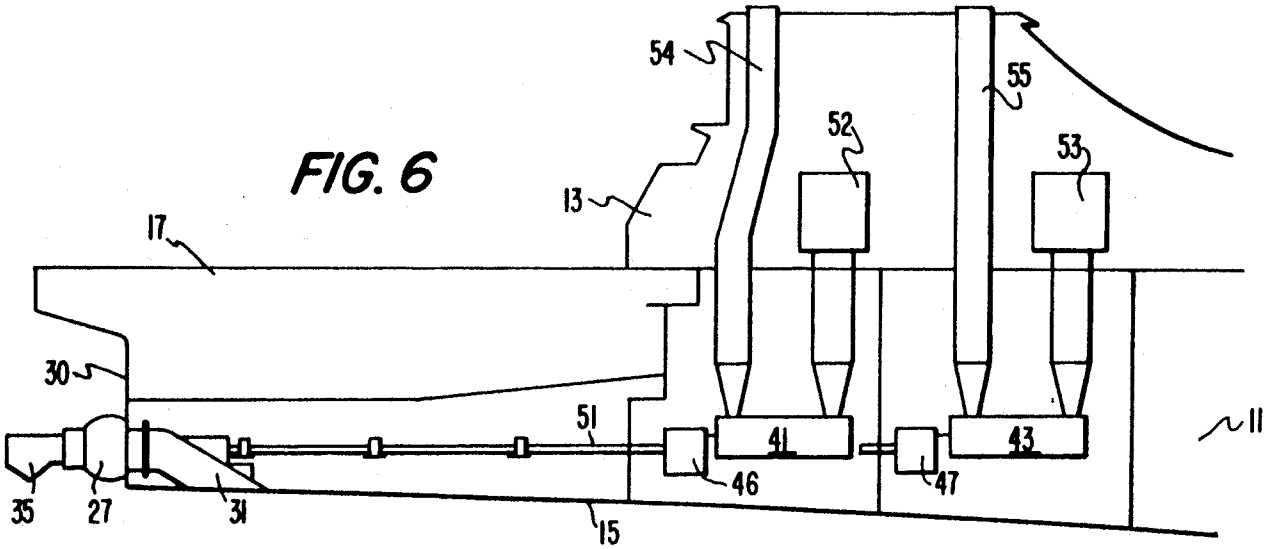
FIGS. 6 and 7 are respectively schematic side elevational and top views showing the arrangement of the waterjet propulsion/gas turbine units within the ship shown in FIG. 1.
Figure 7:
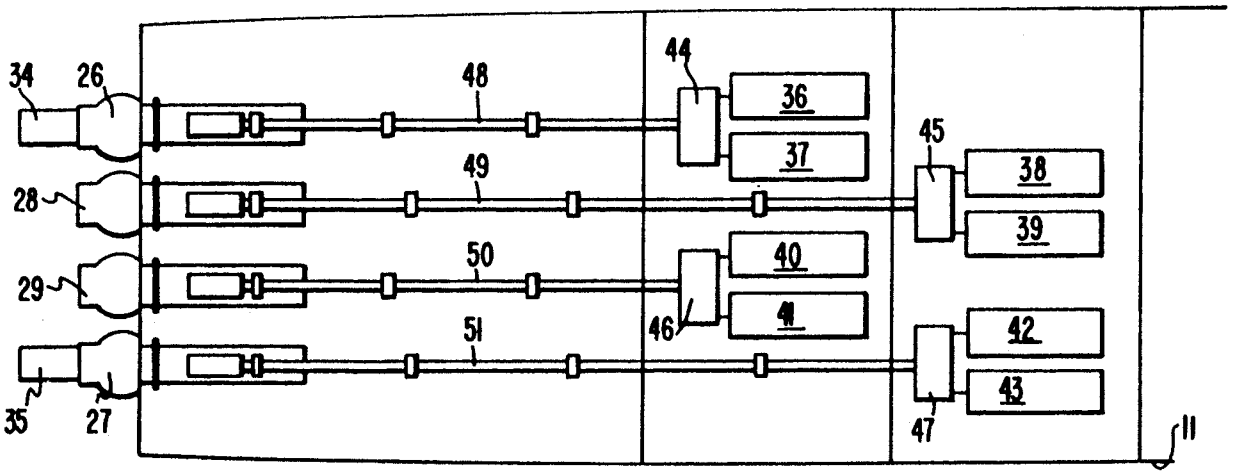

FIGS. 6 and 7 illustrate schematically one embodiment of the waterjet/gas turbine propulsion system. In particular, four waterjet propulsors 26, 27, 28, 29 (one of which is illustrated in FIG. 15) are mounted at the transom 30 with respective inlets 31 arranged in the hull bottom just forward of the transom 30 in an area determined, on an individual hull design basis, of high pressure. Water under high pressure is directed to the impellers of the pumps 32 of the waterjets from the inlets 31. The flow of seawater is accelerated at or around the inlets 31 by the pumps 32 of the four waterjets 26, 27, 28, 29, and this flow acceleration produces additional upward dynamic lift which also increases the hull efficiency by decreasing drag.

The two outermost waterjets 26, 27 are wing waterjets for maneuvering and ahead thrust. Each of the wing waterjets 26, 27 is provided with a horizontally pivoting nozzle 34, 35, respectively, which provides angled thrust for steering. A deflector plate (not shown) directs the jet thrust forward to provide for stopping, slowing control and reversing in a known manner. Steering and reversing mechanisms are operated by hydraulic cylinders (not shown) or the like positioned on the jet units behind the transom. The hydraulic cylinders can be powered by electrical power packs provided elsewhere in the ship. The waterjet propulsion and steering system allows the vessel to be maneuvered at a standstill and also to be decelerated very rapidly.

Marine gas turbines of the type exemplified by General Electric's LM 5000 requires no more than two turbines, each rated at 51,440 HP in 80° F. ambient conditions, per shaft line through a conventional combining gearing installation.

Figure 2:
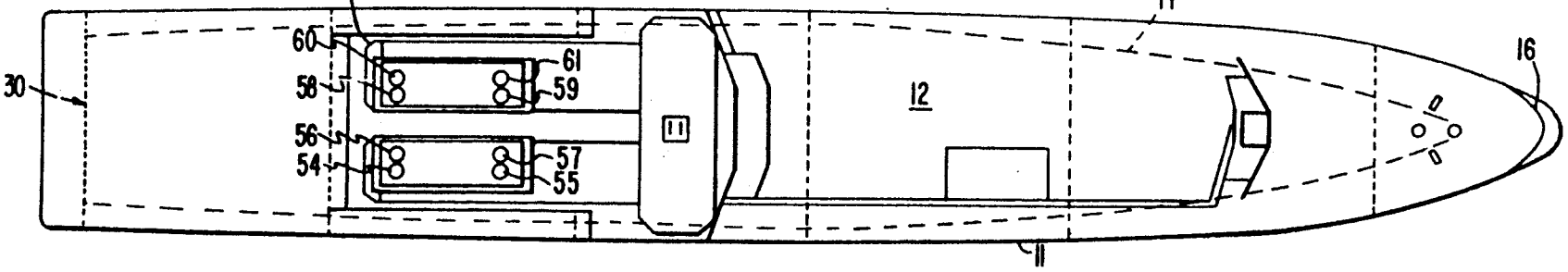
FIG. 2 is a top plan view of the ship shown in FIG. 1.

Eight paired conventional marine gas turbines 36/37, 38/39, 40/41, 42/43 power the waterjet propulsion units 26, 28, 29, 27, respectively, through combined gear boxes 44, 45, 46, 47 and cardan shafts 48, 49, 50, 51. Four air intakes (only two of which 52, 53 are shown in FIGS. 1 and 6) are provided for the turbines 36 through 43 and rise vertically above the main weather deck and open laterally to starboard and port in the superstructure 13 provided in the aft section. Eight vertical exhaust funnels 54, 55, 56, 57, 58, 59, 60, 61 (FIGS. 2 and 6) for each gas turbine also extend through the pilot house superstructure 13 and discharge upwardly into the atmosphere so as to minimize re-entrainment of exhaust gases. The exhaust funnels can be constructed of stainless steel and have air fed therearound through spaces in the superstructure 13 underneath the wheelhouse.

Figure 8A:
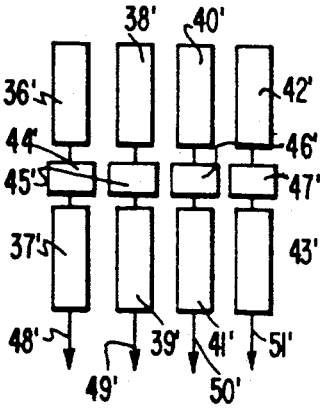
FIGS. 8A through 8D are schematic plan views similar to FIG. 7 showing alternative embodiments of the gas turbines and gear boxes.
Figure 8B:
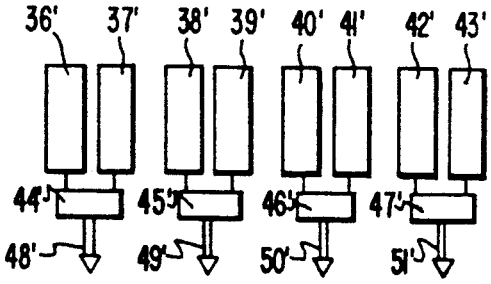
Figure 8C:
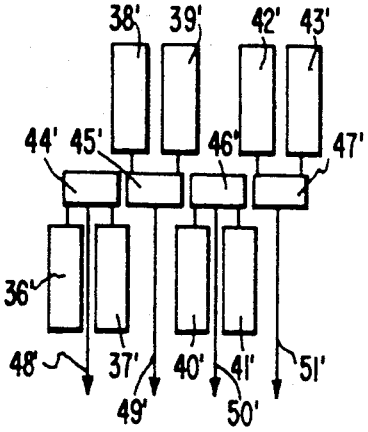
Figure 8D:
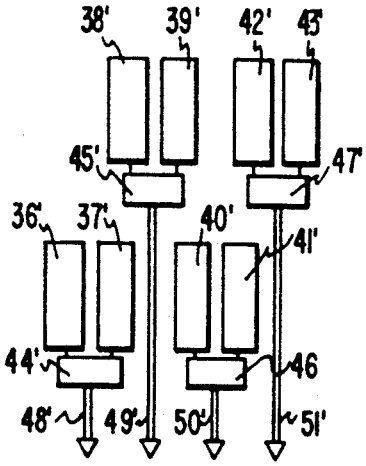

The gas turbine arrangement can take several forms to achieve different design criteria. The parts in FIGS. 8A–8D which are similar to those shown in FIG. 7 are designated by the same numerals but are primed. For example, FIG. 8A shows one embodiment where only four pairs of in-line gas turbines to obtain smaller installation width. A gear box is provided intermediate each pair of in-line turbines. This arrangement results in a somewhat greater installation length and a higher combined gear box and thrust bearing weight for each shaft. FIG. 8B is an embodiment which reduces the installation length where installation width is not deemed essential. Combined gear box and thrust bearing weight per shaft is also reduced to a minimum and to a like amount as the embodiment of FIG. 8D where installation width is somewhere between the embodiments of FIGS. 8A and 8C. The embodiment of FIG. 8C has the gas turbines in two separate rooms to reduce vulnerability.

Figure 9:
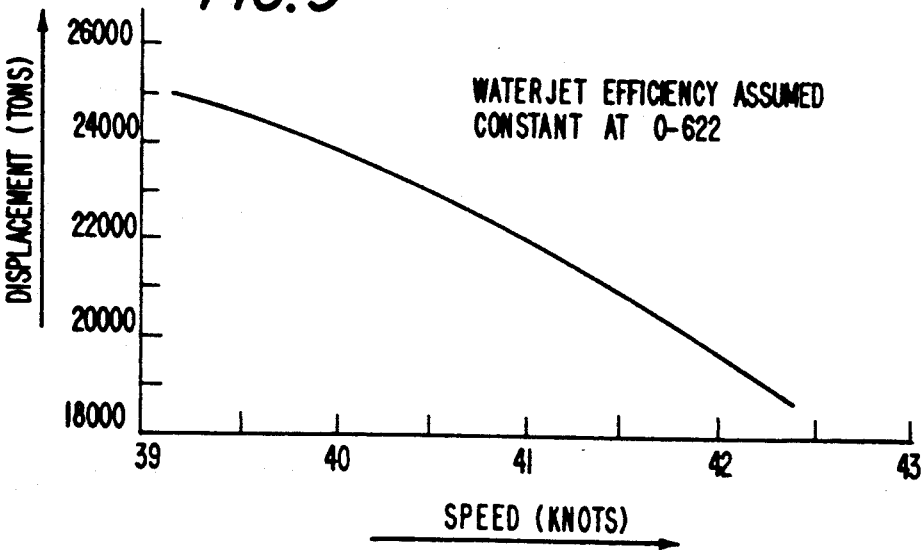
FIG. 9 is a graph showing the relationship between displacement and speed.
Figure 10:
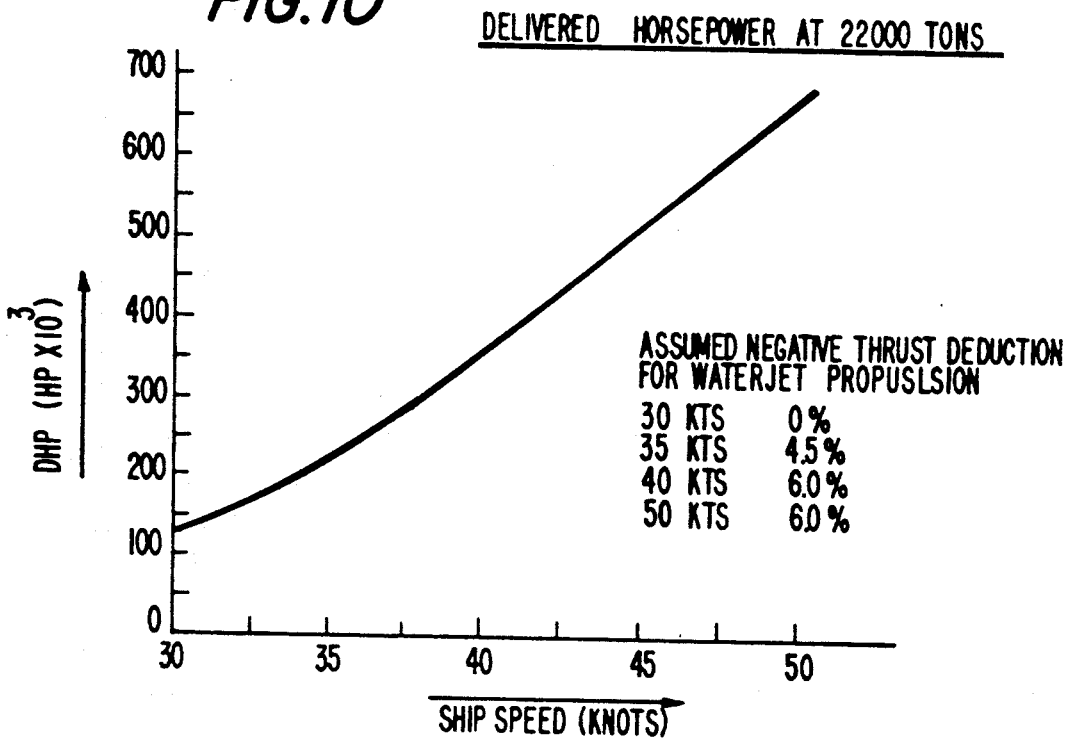
FIG. 10 is a graph showing the relationship between ship speed and delivered horsepower (DHP) for the MFS or SPMH ship described hereinbelow.
Figure 11:
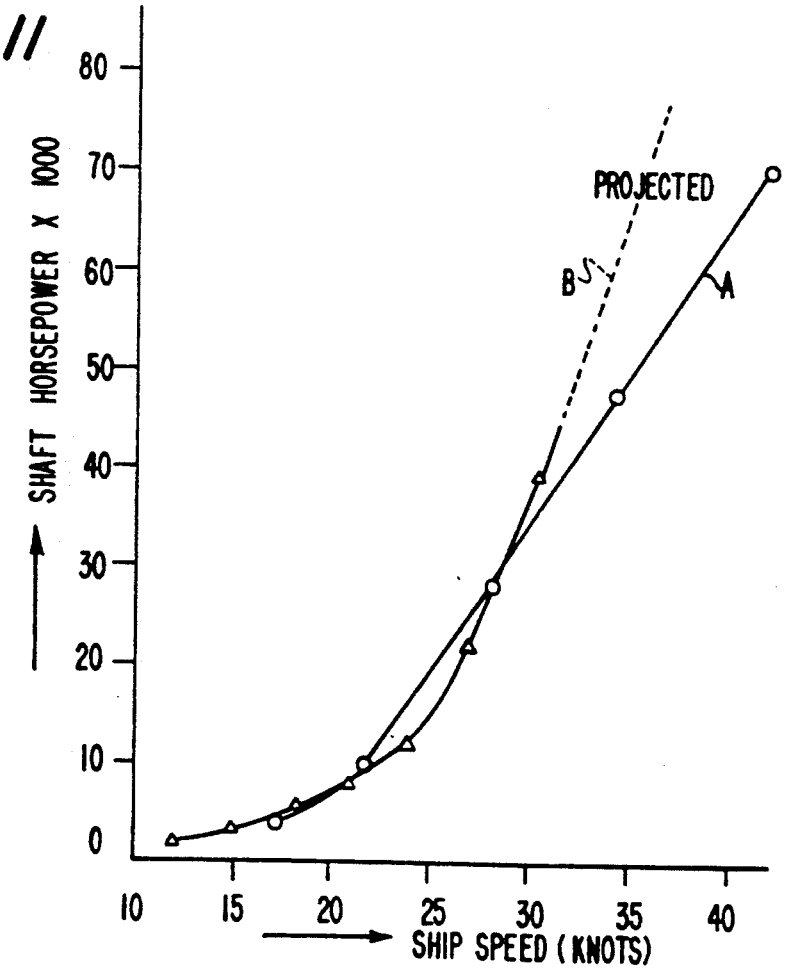
FIG. 11 is a graph showing a comparison of shaft horsepower/speed characteristics between the frigate ship of the present invention and a conventional frigate.

FIG. 9 demonstrates the relationship between ship speed in knots and displacement in tons. At constant waterjet efficiency, speed increases as displacement falls. FIG. 10 shows, however, that linear relationship exists at speeds above 35 knots between delivered horsepower for a vessel of 22,000 tons displacement and ship speed, assuming a certain percentage of negative thrust deductions at certain speeds. For example, to achieve a ship speed of 41 knots, required delivered horsepower will be somewhere around 400,000 according to present tank tests.

Figure 12:
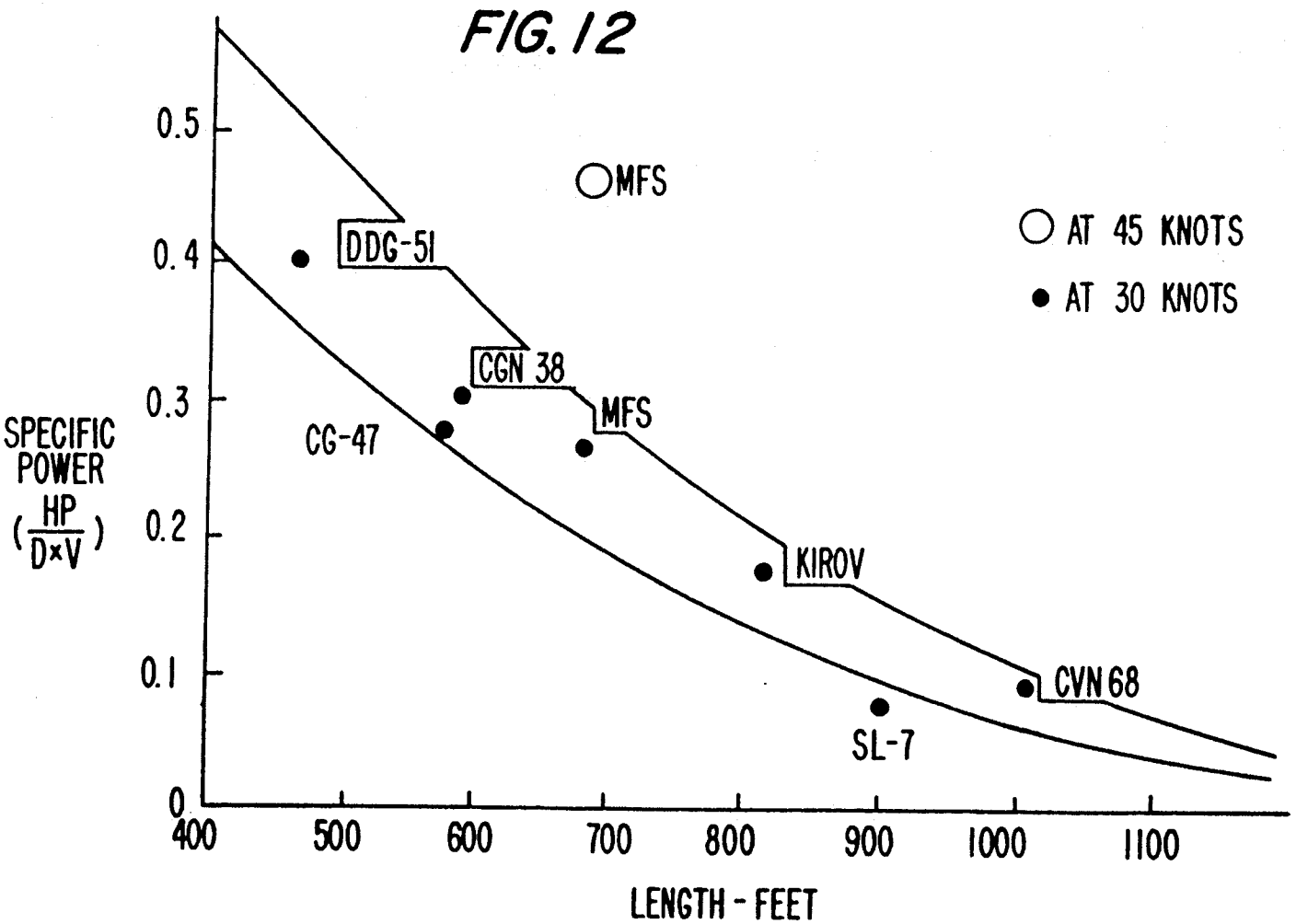
FIG. 12 is a graph comparing the specific power per ton/knot of conventional vessels in terms of their length with that of the present invention.
Figure 13:
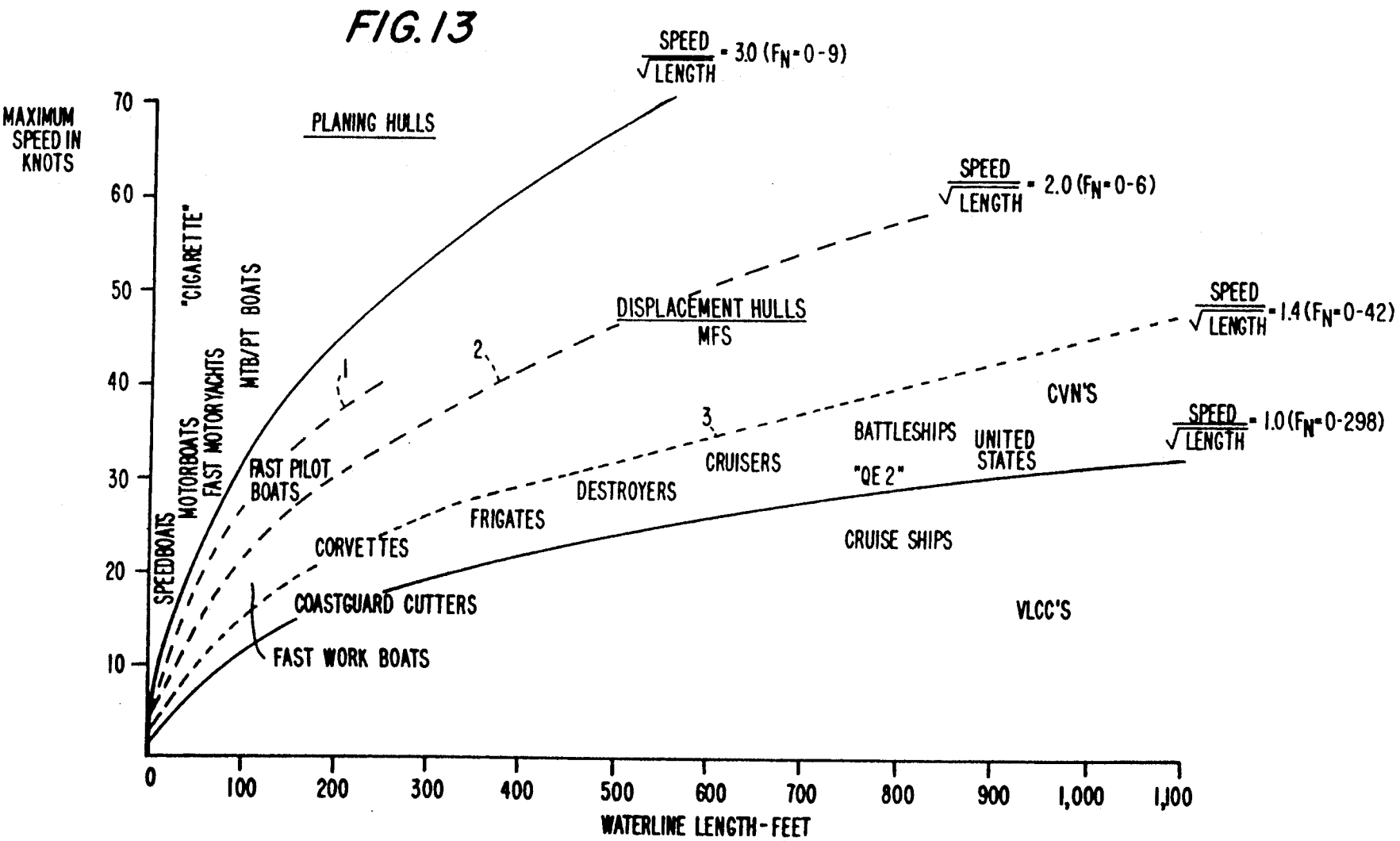
FIG. 13 is a general graph of the speed categories of boats, ships and naval vessels in relation to their respective waterline lengths and demonstrating the utility of the semi-planing hull form in a range of Froude Numbers between above 0.40 and below 1.0 (or $V\sqrt{L}=1.4$ to 3.0)

FIG. 12 shows that at 30 knots, the ship in accordance with the present invention is comparable in performance measured in horsepower per ton/knot to various other classes of vessels according to length and size. At speeds of 45 knots, however, the present invention provides a vessel in a class all by itself.

Figure 19:
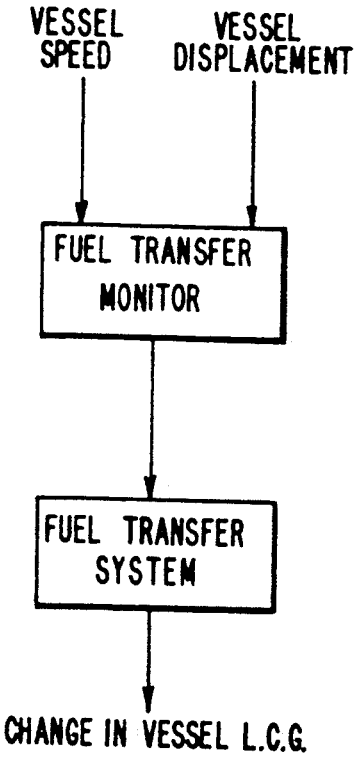
FIG. 19 is a schematic diagram of an embodiment of a fuel transfer system for optimizing trim in the SPMH according to the present invention.

The SPMH in accordance with my invention also incorporates a fuel system which enables the ship to operate at optimum trim or longitudinal center of gravity (L.C.G.) to obtain minimum hull resistance in terms of absorbed effective horsepower (E.H.P.). according to speed and displacement. This is achieved either by the arrangement of the fuel tanks in such a way that, as fuel is burned off and speed consequently increased, the LCG progressively moves aft or by a fuel transfer system operated by a monitor with displacement and speed inputs as shown schematically in FIG. 19 in which fuel is pumped forward or aft of midships (station 5) by a fuel transfer system of conventional construction to adjust the LCG according to the ship's speed and displacement. This fuel transfer is more readily achieved with gas turbine machinery due to the lighter distillate fuels employed which reduce the need for fuel heating prior to being transferred and is particularly useful in vessels which encounter a variety of speed conditions during normal operation.

Figure 17:
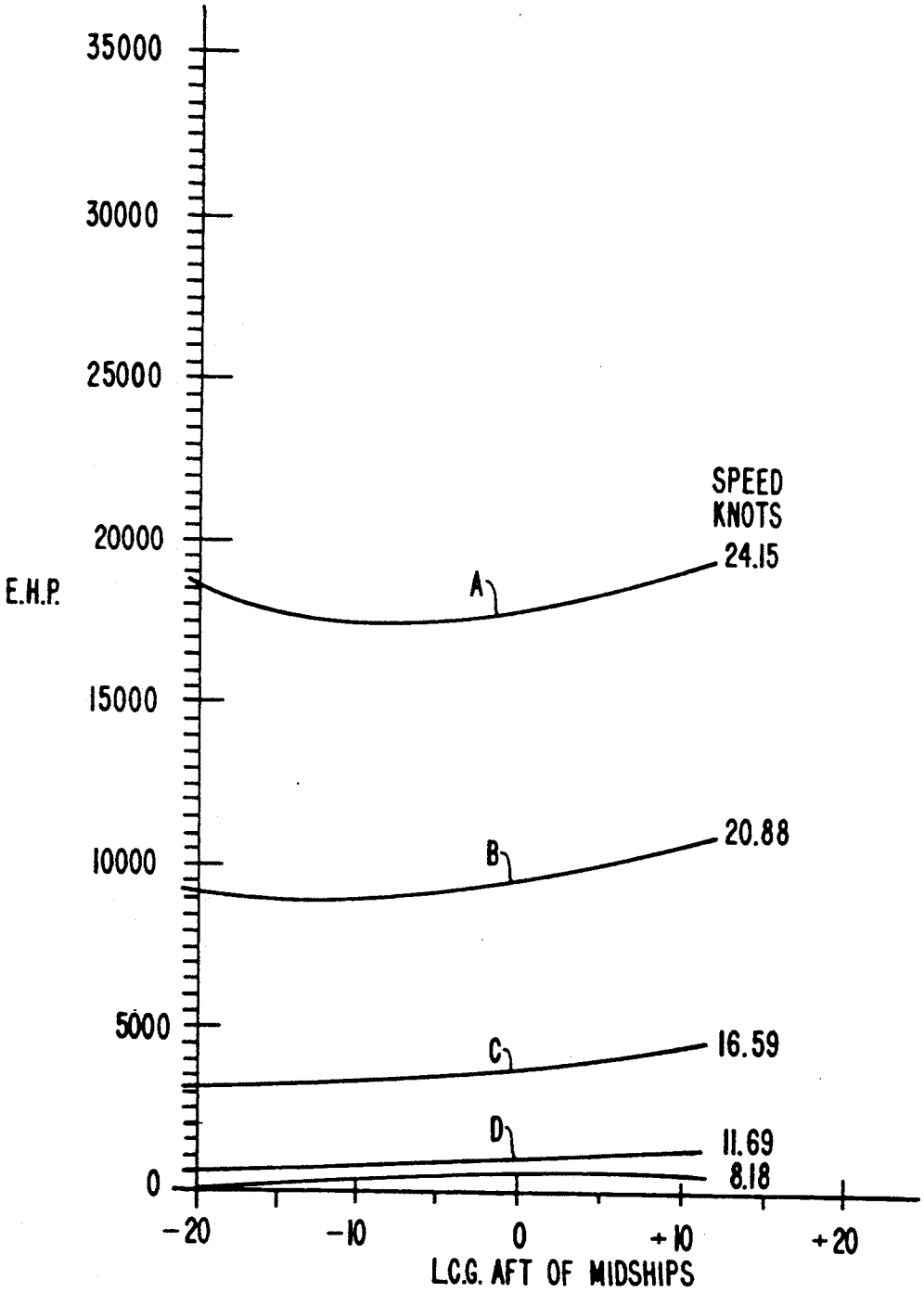
FIG. 17 is a graph based on actual scale model tank tests of a 90 meter, semi-planing hull vessel of 2870 tons displacement showing how the trim of that vessel is optimized by moving the longitudinal center of gravity (L.C.G.) a certain number of feet forward and aft of midships (station 5) designated by the numeral "0" on the abscissa to minimize effective horsepower (E.H.P.) absorbed at different ship speeds.
Figure 18:
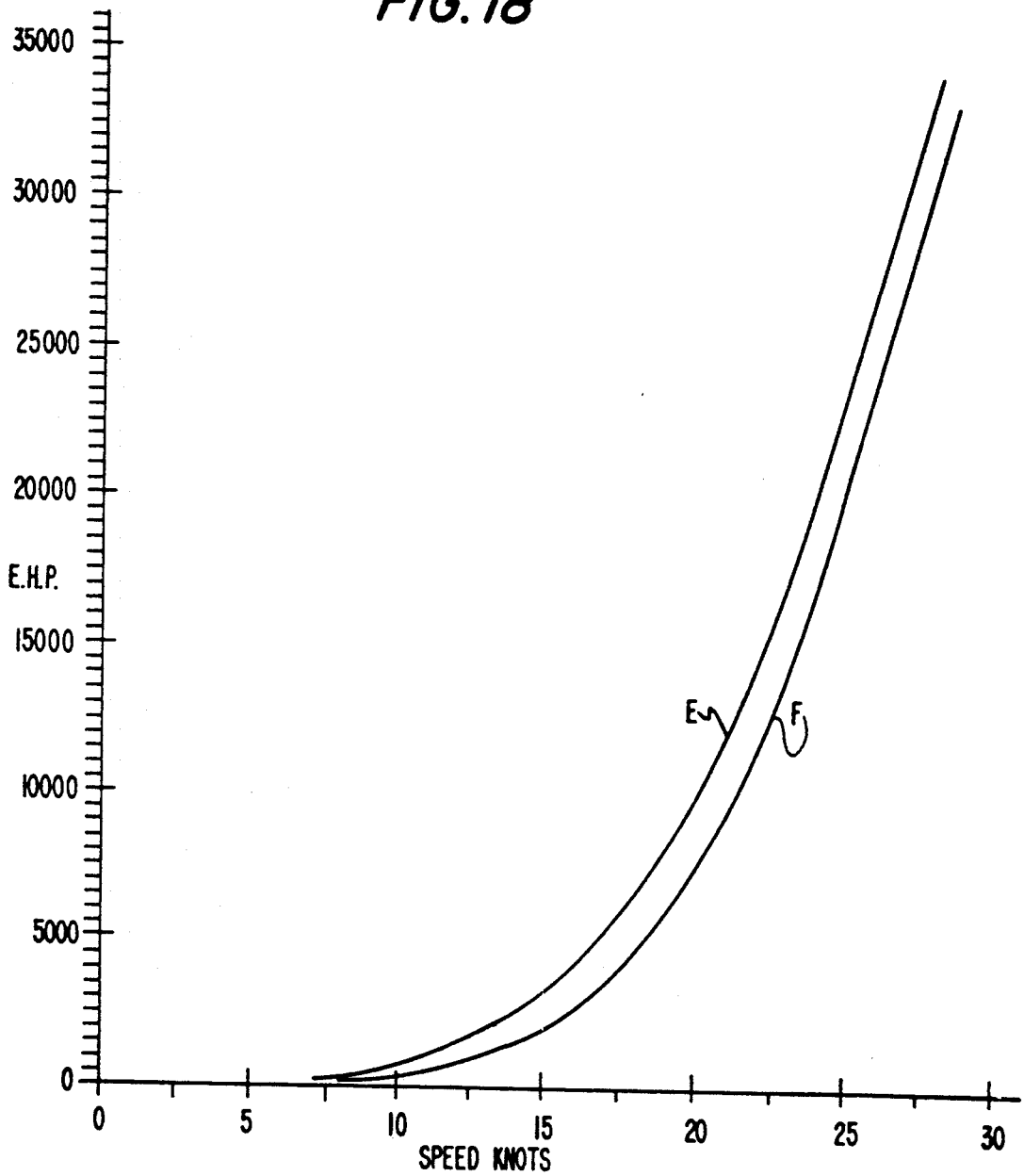
FIG. 18 is a graph based on actual scale model tank tests of the 90 meter, semi-planing hull vessel of 2870 tons displacement referred to above showing the reduction in E.H.P. absorbed where optimized trim is employed.

The advantages of the fuel transfer system, as applied to the SPMH described herein are more clearly understood from experimental scale model tank test results on a conventionally propelled smaller semi-planing hull vessel of 90 meters and 2870 tons as shown in FIGS. 17 and 18.

FIG. 17 demonstrates in general how optimization of trim by moving the longitudinal center of gravity (L.C.G.) forward and aft of midships (station 5 in FIG. 4) by so many feet will reduce the effective horsepower absorbed at certain speeds. The abscissa is scaled in feet and midships is at "0" on the abscissa. Forward of midships is designated by the numerals preceded by a minus sign (e.g. −10 feet) to the left of the zero point and aft of midships by the positive numerals (e.g. 10 feet) to the right of the zero point. Curve A shows that at a speed of 24.15 knots, the optimum trim is obtained by moving the L.C.G. to a point 10 feet forward of midships for minimizing absorbed E.H.P. to a level of 17,250; curve B shows that a speed of 20.88 knots the optimum trim occurs when the LCG is about 13 feet forward so that E.H.P. is at about 8750; curve C shows that at a speed of 16.59 knots the optimum trim occurs when the L.C.G. is about 17 to 18 feet forward; and curves D and E show that at respective speeds of 11.69 knots and 8.18 knots the optimum trim occurs when the L.C.G. is about 20 feet forward of midships. As the displacement of the vessel decreases, e.g. when a substantial amount of fuel has been consumed and speed increases accordingly, optimum trim will occur when the L.C.G. is moved aft of midships to prevent the stern from lifting excessively and thus forcing the bow section down into the water so as to increase resistance.

FIG. 18 illustrates how with a vessel of the foregoing type which has an L/B ratio of about 5.2 optimum trim results in considerable E.H.P. savings particularly at lower speeds. The curve designated by the letter E shows the E.H.P. needed for the vessel having a fixed L.C.G. of 13.62 feet aft of midships, as would be optimum for a speed of 40 knots, over a speed range from about 7.5 knots to about 27.50 knots, and the solid curve designated by the letter F shows the E.H.P. needed when the trim is optimized by moving the L.C.G. forward and aft according to speed and displacement in the manner shown in FIG. 17. It Will be seen that, for example, of a speed of 10 knots for this type of vessel, the E.H.P. is reduced by about 50% using optimized trim, and at a speed of 15 knots the power needed is reduced by about 37%. Similar results are achieved with a ship in accordance with the present invention where the L/B ratio is somewhat higher, although the percentage E.P.H. reductions may not be quite as high as the results illustrated in FIG. 18. In this connection, the 12.5 knot speed in FIG. 18 which shows a reduction from 1600 E.H.P. using a fixed L.C.G. to 850 E.H.P. using optimized trim will correspond to a 20 knot speed for the SPMH of the present invention, which speed will be a practicable and economic speed for commercial purposes. Likewise, the results shown in FIG. 18 will not be as high as with a ship of the same waterline length and L/B ratio but with lower displacement.

Optimization of trim according to changes in vessel speed and displacement is also useful in ensuring optimum immersion of the waterjet pipes which require the point of maximum diameter of their outlet pipes to be level with the waterline when they are started with the ship at a standstill for proper pump priming. There are also several operational advantages of such a trim optimization system, particularly when using shallow water harbors.

The hull in accordance with the present invention has a length-to-beam ratio of between about 5 to 1 and 7 to 1 to achieve a ship design having excellent seakeeping and stability while providing high payload carrying capability. Tank tests suggest that this new vessel design will have a correlation, or $(1+x)$, factor of less than one. A correlation factor is usually in excess of one for conventional hulls (see curves A and B in FIG. 14), normally a value of 1.06 to 1.11 being recommended. This is added to tank resistance results to approximate the actual resistance in a full scale vessel. Thus, a correlation factor of less than one coupled with the hydrodynamic lift is anticipated to result in about a 25% decrease in resistance in the vessel at 45 knots according to my invention as shown by curves C and D in FIG. 14. A typical ship constructed in accordance with the principles of the present invention will have the following types of characteristics:

| PRINCIPAL DIMENSIONS | | |
|---|---|---|
| Length Overall | 774' 0" | |
| Length Waterline | 679' 0" | |
| Beam Molded | 116' 5" | |
| Beam Waterline | 101' 8" | |
| Depth Amidships | 71' 6" | |
| Draft (Full Load) | 32' 3" | |
| DISPLACEMENT | | |
| Overload | 29,526 | long tons |
| Full Load | 24,800 | long tons |
| Half-fuel Condition | 22,000 | long tons |
| Arrival Condition | 19,140 | long tons |
| Light Ship | 13,000 | long tons |

SPEED 40 to 50 knots in the half-fuel condition.

ENDURANCE

The endurance is 3500 nautical miles with a 10% reserve margin.

ACCOMMODATIONS

Total of twenty (20) ship handling crew and thirty (30) load handling crew.

All accommodations and operational areas are to be air conditioned.

PROPULSION MACHINERY

Eight (8) marine gas turbines, each developing an output power of about 50,000 HP in an air temperature of 80° F.

Four (4) waterjets, two with steering and reversing gear.

Four (4) combining speed reduction gearboxes.

Three (3) main diesel-driven a.c. generators and one emergency generator.

Figure 16:
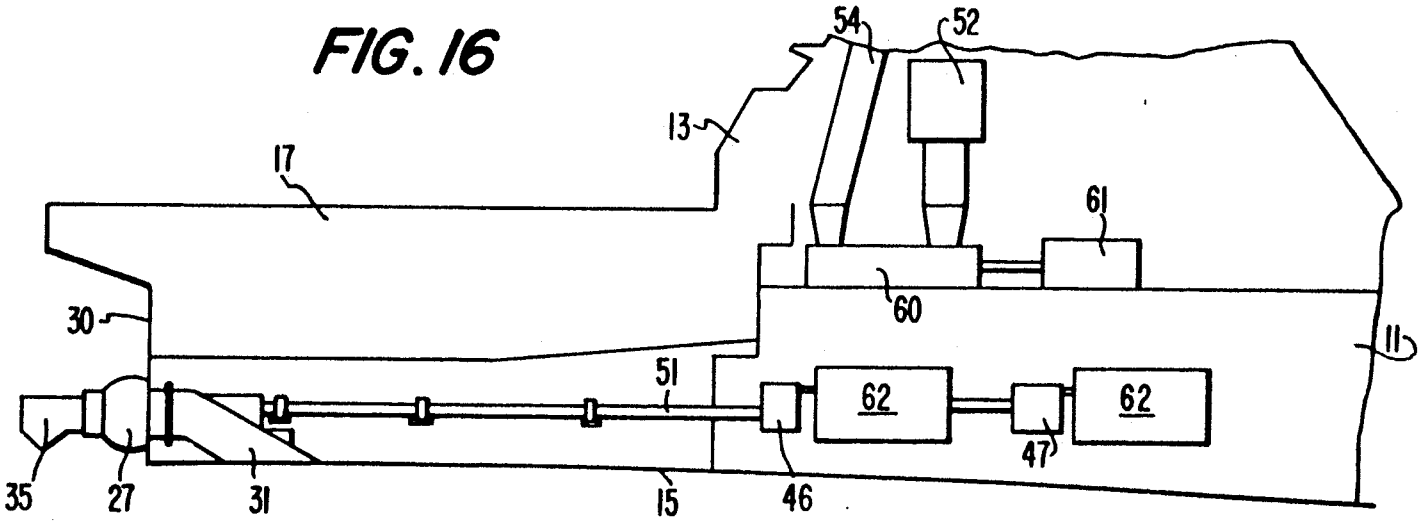
FIG. 16 is a schematic view similar to FIG. 6 but showing a modified gas turbine/electric motor drive for the waterjet propulsion system.

It should be clearly understood that my invention is not limited to the details shown and described above, particularly the characteristics listed in the immediately preceding paragraph, but is susceptible of changes and modifications without departing from the principles of my invention. For instance, FIG. 16 depicts an embodiment where the gas turbines 60 driving one or more generators 61 serve as the primary electrical power source and are carried higher in the vessel than in the FIG. 6 embodiment. The electric power generated by the turbines 60 via the generator or generators 61 is used to turn motors 62 which, with or without gearboxes 46, 47, drive the waterjets 26', 27', 28', 29' which are otherwise identical to the waterjets described with respect to FIGS. 6, 7 and 15. Therefore, I do not intend to be limited to the details shown and described herein but intend to cover all such changes and modifications as fall within the scope of the appended claims.

I claim:

1. A vessel comprising:

a hull having a non-stepped profile which produces a high pressure area at the bottom of the hull in a stern section of the hull which intersects a transom to form an angle having a vertex at the intersection and hydrodynamic lifting of the stern section at a threshold speed without the hull planing across the water at a maximum velocity determined by a Froude Number, the hull having a length in excess of 200 feet, a displacement in excess of 2000 tons, and a Froude Number in between 0.42 and 0.90;

at least one inlet located within the high pressure area;

at least one waterjet coupled to the at least one inlet for discharging water which flows from the inlet to the waterjet for propelling the vessel;

a power source coupled to the at least one waterjet for propelling water from the at least one inlet through the waterjet to propel the vessel and to discharge the water from an outlet of the waterjet; and wherein acceleration of water into the at least one inlet and from the at least one waterjet produces hydrodynamic lift at the at least one inlet which is additional to the lifting produced by the bottom of the hull in the high pressure area which increases efficiency of the hull and reduces drag.

2. A vessel according to claim 1 wherein:

the power source is at least one gas turbine.

3. A vessel comprising:

a hull having a non-stepped profile which produces a high pressure area at the bottom of the hull in a stern section of the hull which intersects a transom to form an angle having a vertex at the intersection and hydrodynamic lifting of the stern section at a threshold speed without the hull planning across the water at a maximum velocity determined by a Froude Number, the hull having a displacement in excess of 2000 tons, and a Froude Number in between 0.42 and 0.90;

at least one inlet located within the high pressure area;

at least one waterjet coupled to the at least one inlet for discharging water which flows from the inlet to the waterjet for propelling the vessel;

a power source coupled to the at least one waterjet for propelling water from the at least one inlet through the waterjet to propel the vessel and to discharge the water from an outlet of the waterjet; and wherein acceleration of water into the at least one inlet and from the at least one waterjet produces hydrodynamic lift at the at least one inlet which is additional to the lifting produced by the bottom of the hull in the high pressure area which increases efficiency of the hull and reduces drag.

4. A vessel according to claim 3 wherein:

the power source is at least one gas turbine.

5. A vessel conveying method comprising the steps:

hydrodynamically lifting a stern section of a vessel hull at a threshold ship speed by virtue of a high pressure region at the bottom of the hull with the hull having a non-stepped profile, a length in excess of 200 feet, a displacement in excess of 2000 tons, and a Froude Number in between 0.42 and 0.90;

propelling the hydrodynamically lifted hull via a waterjet system having water inlets in the high pressure region with the hull not planing across the water at a maximum velocity determined by the Froude Number; and accelerating water flow into the inlets to increase the pressure in the high pressure region and to produce further lifting of the hull which increases efficiency of the hull and reduces drag.

6. A vessel conveying method in accordance with claim 5 further comprising:

driving the waterjet system with at least one gas turbine.

7. A vessel conveying method comprising the steps:

hydrodynamically lifting a stern section of a vessel hull at a threshold ship speed by virtue of a high pressure region at the bottom of the hull with the hull having a non-stepped profile, a displacement in excess of 2000 tons, and a Froude Number in between 0.42 and 0.90;

propelling the hydrodynamically lifted hull via a waterjet system having water inlets in the high pressure region with the hull not planing across the water at a maximum velocity determined by the Froude Number; and accelerating water flow into the inlets to increase the pressure in the high pressure region and to produce further lifting of the hull which increases efficiency of the hull and reduces drag.

8. A vessel conveying method in accordance with claim 7 further comprising:

driving the waterjet system with at least one gas turbine.

* * * * *